US008210111B2

(12) United States Patent
Ries

(10) Patent No.: US 8,210,111 B2
(45) Date of Patent: Jul. 3, 2012

(54) METHOD AND SYSTEM FOR LINING A COAL BURNER NOZZLE

(75) Inventor: Donald Edwin Ries, Fultz, IL (US)

(73) Assignee: C.L. Smith Industrial Company, Arnold, MO (US)

( * ) Notice: Subject to any disclaimer, the term of this patent is extended or adjusted under 35 U.S.C. 154(b) by 799 days.

(21) Appl. No.: 12/393,824

(22) Filed: Feb. 26, 2009

(65) Prior Publication Data

US 2009/0211502 A1 Aug. 27, 2009
US 2010/0132597 A2 Jun. 3, 2010

Related U.S. Application Data

(60) Provisional application No. 61/032,047, filed on Feb. 27, 2008.

(51) Int. Cl.

| | |
|---|---|
| ***F23K 3/00*** | (2006.01) |
| ***F23K 3/02*** | (2006.01) |
| ***F15D 1/02*** | (2006.01) |
| ***F16L 9/18*** | (2006.01) |

(52) U.S. Cl. ..... 110/267

(58) Field of Classification Search ..... 110/106, 110/108, 323, 260, 261, 262, 263, 264, 265, 110/267; 138/39, 114; 239/591
See application file for complete search history.

(56) References Cited

U.S. PATENT DOCUMENTS

| | | | | |
|---|---|---|---|---|
| 4,356,975 | A | 11/1982 | Chadshay | |
| 4,380,202 | A * | 4/1983 | LaRue et al. | 110/263 |
| 4,520,739 | A | 6/1985 | McCartney et al. | |
| 4,634,054 | A | 1/1987 | Grusha | |
| 5,483,906 | A | 1/1996 | Hufton | |
| 6,105,516 | A * | 8/2000 | Bowen | 110/261 |
| 6,145,449 | A | 11/2000 | Kaneko et al. | |
| 6,439,136 | B1 | 8/2002 | Mann et al. | |
| 6,840,183 | B2 * | 1/2005 | Wark | 110/106 |
| 7,216,594 | B2 | 5/2007 | Nowak et al. | |

FOREIGN PATENT DOCUMENTS

GB 2078900 * 1/1982

* cited by examiner

*Primary Examiner* — Kenneth Rinehart
*Assistant Examiner* — David J Laux
(74) *Attorney, Agent, or Firm* — Armstrong Teasdale LLP

(57) ABSTRACT

A method and liner system for a pneumatically conveyed particulate conduit are provided. The conduit includes an inlet opening, an outlet opening, and a duct extending therebetween. The system includes a first polygonally-shaped wall member extending from an inlet opening end of the conduit to an opposing outlet opening end of the conduit. The first wall member includes a substantially planar body. The liner system further includes a second polygonally-shaped wall member extending from the inlet opening end of the conduit to the opposing outlet opening end of the conduit. The second wall member includes a substantially planar body having an integrally formed anti-roping bar that extends outwardly from a surface of the second wall member a predetermined height into a flow path through the duct. The liner system further includes a curved polygonally-shaped corner member extending from the inlet opening end of the conduit to the opposing outlet opening end of the conduit.

24 Claims, 5 Drawing Sheets

METHOD AND SYSTEM FOR LINING A COAL BURNER NOZZLE

CROSS REFERENCE TO RELATED APPLICATIONS

This application claims priority to and the benefit of the filing date of U.S. Provisional Application No. 61/032,047 filed on Feb. 27, 2008, which is hereby incorporated by reference in its entirety.

BACKGROUND OF THE INVENTION

This invention relates generally to a burner for a coal-fired furnace and more particularly to a method and systems for a stationary coal nozzle for a burner on a coal-fired furnace.

At least some known combustion systems include burners that inject a stream of a pulverized coal and air mixture into a combustion zone through a nozzle. The pulverized coal impinges on burner internal components causing wear and over time may degrade the function of the burner. Additionally, coal roping may cause poor fuel distribution exiting the nozzle tip or outlet which results in flame variations. These flame variations range from sub-stoichiometric fuel rich zones, where the reducing atmosphere contributes to slagging and water wall erosion, to high oxygen zones, which potentially create high thermal generation oxides of nitrogen. Coal roping is generally associated with centrifugal flow patterns in the coal/air stream established by elbows and pipe bends.

Burner wear has been addressed using blocks of material that is wear resistant such as ceramics, by sacrificial metal guards with increased hardness, and/or by metallizing the wear surfaces of the burner. Coal roping has been addressed using ramp segments extending into the flow stream or with kicker plates blocking a portion of the flow. However, such techniques have only achieved limited success.

BRIEF DESCRIPTION OF THE INVENTION

In one embodiment, a liner system for a pneumatically conveyed particulate conduit includes a first polygonally-shaped wall member extending from an inlet opening end of the conduit to an opposing outlet opening end of the conduit. The first wall member includes a substantially planar body. The liner system further includes a second polygonally-shaped wall member extending from the inlet opening end of the conduit to the opposing outlet opening end of the conduit. The second wall member includes a substantially planar body having an integrally formed anti-roping bar that extends outwardly from a surface of the second wall member a predetermined height into a flow path through the duct. The liner system further includes a curved polygonally-shaped corner member extending from the inlet opening end of the conduit to the opposing outlet opening end of the conduit.

In another embodiment, a method of lining a duct includes attaching a plurality of wall tiles to the one or more duct walls by aligning an apex corner of a triangularly-shaped ceramic wall tile with an edge of the substantially elliptical first opening, aligning a base edge of the triangularly-shaped ceramic wall tile with an edge of the substantially rectangular second opening, coupling the triangularly-shaped ceramic wall tile to the one or more duct walls, aligning a base edge of a curved triangularly-shaped ceramic corner tile with an edge of the substantially elliptical first opening, aligning an apex end of the curved triangularly-shaped ceramic corner tile with a corner of the substantially rectangular second opening, and coupling the curved triangularly-shaped ceramic corner tile to the one or more duct walls using at least one of a weld to a weld insert in the curved triangularly-shaped ceramic corner tile and a high-temperature mortar. At least one of the plurality of wall tiles includes an anti-roping bar that is integrally formed with the at least one of the plurality of wall tiles, the anti-roping bar extending outwardly away from a surface of the at least one of the plurality of wall tiles into a flow path through the duct. The duct includes a first opening having a substantially elliptical cross-section, a second opening having a substantially rectangular cross-section, and one or more duct walls extending therebetween, the one or more duct walls shaped to form a transition from the substantially elliptical first opening to the substantially rectangular second opening.

In yet another embodiment, a pulverized coal burner includes a nozzle tip at least partly protruding into a furnace and a pulverized coal nozzle coupled in flow communication between the nozzle tip and a supply of a flow of fluidly conveyed particulate fuel wherein the pulverized coal nozzle includes a duct having an inlet opening, an outlet opening, and a plurality of walls extending therebetween. The duct further includes a liner system formed of abrasion resistant ceramic tiles coupled to the plurality of walls along an inner surface of the duct wall. The liner system includes a first polygonally-shaped wall member extending from the inlet opening to the outlet opening and including a substantially planar body. The liner system also includes a second polygonally-shaped wall member extending from the inlet opening to the outlet opening, and including a substantially planar body having an integrally formed anti-roping bar that extends outwardly from a surface of the second wall member a predetermined height into a flow path through the duct. The liner system further includes a curved polygonally-shaped corner member extending from an inlet opening end of the conduit to an opposing outlet opening end of the conduit.

BRIEF DESCRIPTION OF THE DRAWINGS

FIGS. 1-5 show exemplary embodiments of the method and system described herein.

FIG. 1 is a side schematic view of a boiler in accordance with an exemplary embodiment of the present invention;

FIG. 2 is a side schematic view of a conveying duct such as a burner nozzle shell in accordance with an exemplary embodiment of the present invention;

FIG. 4 is a perspective view of the nozzle shown in FIG. 2 looking from the outlet opening through the nozzle to the inlet opening at an angle with respect to the longitudinal axis; and FIG. 5 is another perspective view of the nozzle shown in FIG. 2 looking from the outlet opening through the nozzle to the inlet opening.

DETAILED DESCRIPTION OF THE INVENTION

The following detailed description illustrates embodiments of the invention by way of example and not by way of limitation. It is contemplated that the invention has general application to fluidly conveyed particles and solids in industrial, commercial, and residential applications.

As used herein, an element or step recited in the singular and proceeded with the word "a" or "an" should be understood as not excluding plural elements or steps, unless such exclusion is explicitly recited. Furthermore, references to "one embodiment" of the present invention are not intended to be interpreted as excluding the existence of additional embodiments that also incorporate the recited features.

Figure 1:
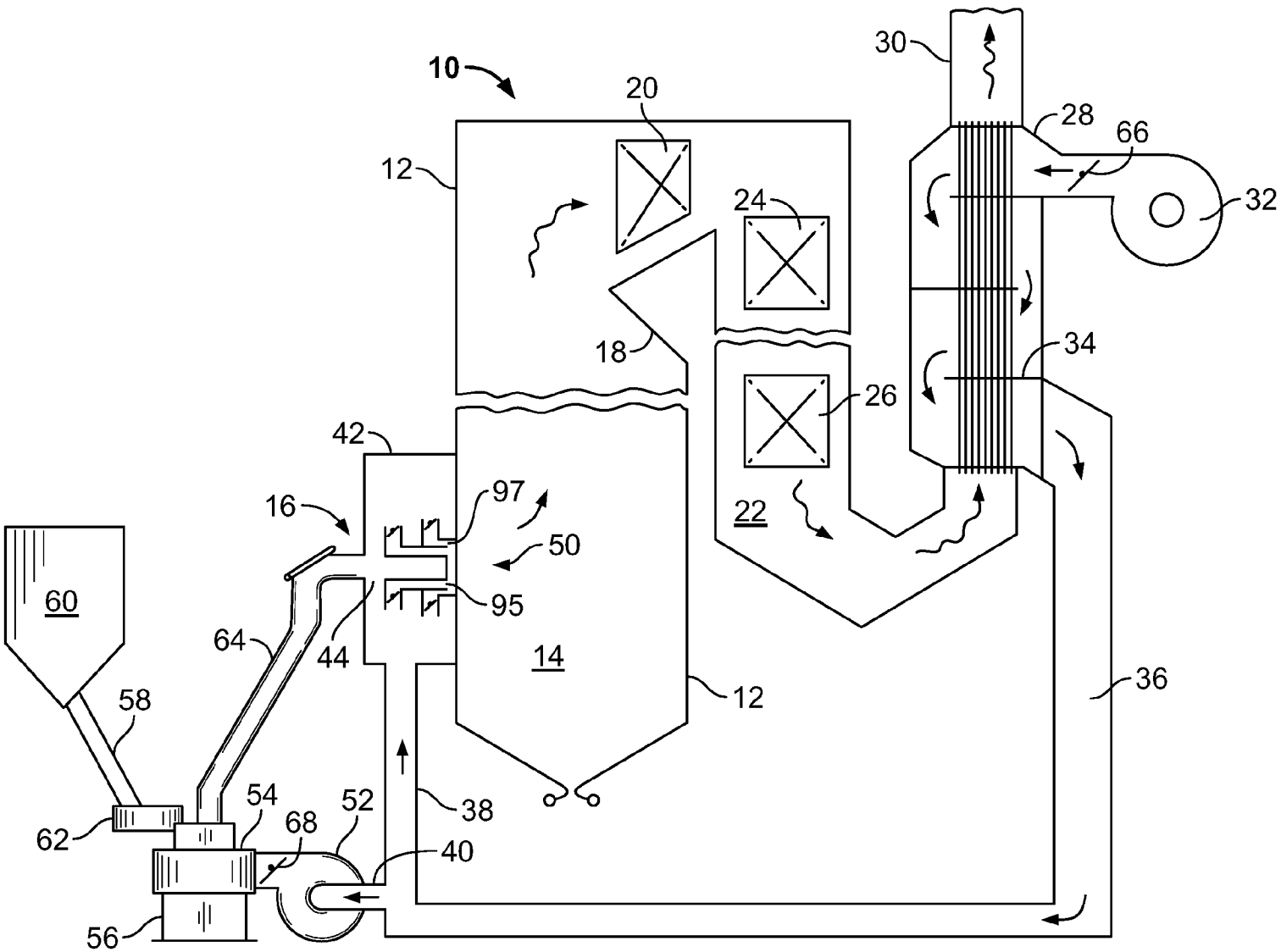

FIG. 1 is a side schematic view of a boiler 10 in accordance with an exemplary embodiment of the present invention. In the exemplary embodiment, boiler 10 includes water-cooled walls 12 which define a furnace 14 to which a coal and air mixture is supplied by a pulverized fuel burner 16. After combustion has been completed in a chamber of furnace 14, the heated gases formed during combustion flow upwardly around a nose portion 18, over a tubular secondary superheater 20, and downwardly through a convection pass 22 containing a tubular primary superheater 24 and an economizer 26. The heated gases leaving convection pass 22 flow through tubes of an air heater 28 and are thereafter discharged through a stack 30. It will be understood that the heated gases passing over superheaters 20 and 24 and economizer 26 give up heat to the fluid flowing therethrough and that the gases passing through air heater 28 give up additional heat to the combustion air flowing over the tubes. A forced draft fan 32 supplies combustion air to boiler 10 and causes it to flow over the air heater tubes and around a plurality of baffles 34 and through a duct 36 for apportionment between branch ducts 38 and 40 respectively.

Air passing through duct 38 is delivered into a windbox 42 and represents a major portion of the air necessary for combustion of the fuel being discharged from nozzle 44 associated with fuel burner 16. The windbox air is apportioned between an inner annular passageway 95 and an outer annular passageway 97 for discharge through a burner tip 50 and into furnace 14.

Air passing through duct 40 is the remaining portion of air necessary for combustion and is delivered into a primary air fan 52 wherein it is further pressurized and thereafter conveyed through a duct 54 into an air-swept type pulverizer or mill 56.

Fuel to be burned in boiler 10 is delivered in raw form via a pipe 58 from a raw fuel storage bunker 60 to a feeder 62 in response to a load demand on boiler 10. Mill 56 grinds the raw fuel to a desired particle size. Pressurized air from primary air fan 52 sweeps through mill 56 carrying therewith the ground fuel particles for flow through a pipe 64 to burner nozzle 44 for discharge through burner tip 50 into furnace 14.

A damper 66 is associated with forced draft fan 32 to regulate a total quantity of air being admitted to boiler 10 in response to the load demand. A damper 68 is associated with primary air fan 52 to regulate a quantity of air being introduced through burner nozzle 44.

For clarity the drawings depict one fuel burner 16 associated with one mill 56 wherein in actual practice there may be more than one burner 16 associated with each mill 56 and there may be more than one mill 56 associated with boiler 10.

Figure 2:
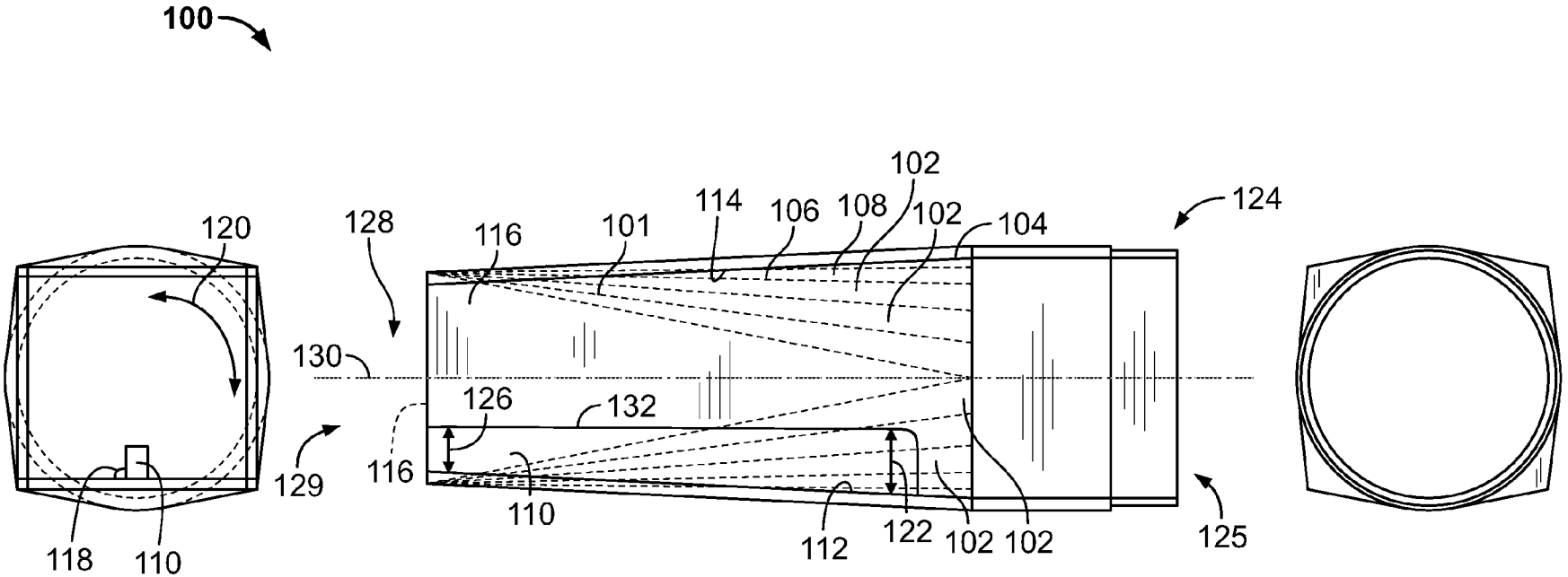

FIG. 2 is a side schematic view of a conveying duct such as a burner nozzle shell 100 in accordance with an exemplary embodiment of the invention. In the exemplary embodiment, a liner system 101 is formed from a plurality of burner liner wear plates or tiles 102 that are fabricated in generally non-rectangular shapes to accurately match an inner surface 104 of burner nozzle shell 100. The tiles 102 are attached to inner surface 104 of burner nozzle shell 100. The plurality of tiles 102 are positioned within burner nozzle shell 100 for use on for example, but not limited to a coal-fired furnace 14 (shown in FIG. 1). Liner system 101 includes longitudinally extending ceramic tiles 102 having at least two opposing side edges longitudinally converging toward one another for transitioning between an elliptical cross-section of burner nozzle shell 100 at an inlet end 124 and a rectangular cross-section of the nozzle at an outlet end 128. Tiles 102 are specifically positioned within burner nozzle shell 100 to form nozzle liner system 101. In the exemplary embodiment, tiles 102 are mechanically attached to the outer shell using mechanical fasteners (not shown) and welds. Tiles 102 are also bonded together using a high temperature mortar 106. In an alternative embodiment, tiles 102 are bonded to inner surface 104 using a high-temperature mortar and gaps 108 between tiles 102 are filled to present a smooth surface between adjacent tiles 102. Elongated tiles 102 are used to reduce the number of possible wear-susceptible components of the nozzle liner system 101, as compared to using smaller, rectangular tile pieces to form the nozzle interior. At least one of tiles 102 includes an anti-roping bar 110 that extends longitudinally along tile 102 and radially within burner nozzle shell 100 to facilitate dispersing the pulverized coal that flows through burner nozzle shell 100. In the exemplary embodiment, anti-roping bar 110 is cast with a respective tile 102. In an alternative embodiment, anti-roping bar 110 is a separate component adhered to tiles 102 in predetermined locations and longitudinal configurations.

In various other embodiments, tile 102 including anti-roping bar 110 extends longitudinally along a bottom surface 112, a top surface 114, a side surface 116, or a combination thereof of burner nozzle shell 100. In the exemplary embodiment, anti-roping bar 110 extends radially into burner nozzle shell 100 substantially perpendicularly to the tile 102. In other embodiments, anti-roping bar 110 is tilted at a predetermined angle 118 in a circumferential direction 120. Anti-roping bar 110 extends outwardly from the liner tile 102 a first height 122 proximate inlet end 124 of burner nozzle shell 100 and extends outwardly from the liner tile 102 a second height 126 proximate an outlet end 128 of burner nozzle shell 100. In the exemplary embodiment, second height 126 is greater than first height 122. In an alternative embodiment, first height 122 is greater than second height 126. In still another embodiment, first height 122 and second height 126 are substantially equal.

Burner nozzle shell 100 includes converging top, bottom, and sides that transition from a substantially elliptical cross-section to a substantially rectangular or square cross-section at outlet end 128. As used herein, elliptical is intended to refer to various closed arcuate shapes including but not limited to circular and oval cross-sections. The elliptical cross-section may be flanged to mate with a coal supply pipe 64 (shown in FIG. 1). Burner nozzle shell 100 is generally symmetric about a longitudinal axis 130 extending through a centerline of an inlet end opening 125, an outlet end opening 129, and burner nozzle shell 100 extending therebetween. In the exemplary embodiment, first height 122 and second height 126 are selected to provide for a radially inner surface 132 of anti-roping bar 110 being substantially parallel to the longitudinal axis 130. Accordingly, first height 122 is greater than second height 126 an amount that permits a slope of anti-roping bar 110 to match the convergence of the burner nozzle shell 100 from inlet end 124 to outlet end 128. In the exemplary embodiment radially inner surface 132 is substantially straight between the inlet and outlet side. In various alternative embodiments radially inner surface 132 is not linear.

Figure 3A:
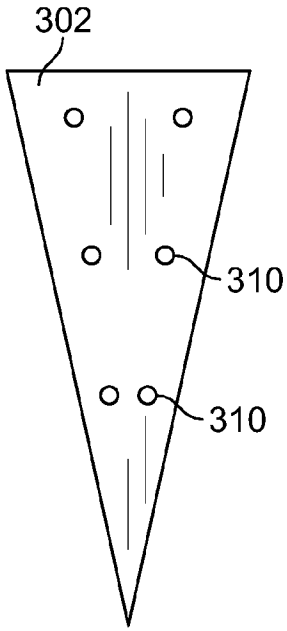
FIG. 3A is a plan view of a bottom wall member of the liner system shown in FIG. 2 in accordance with an exemplary embodiment of the present invention.
Figure 3B:
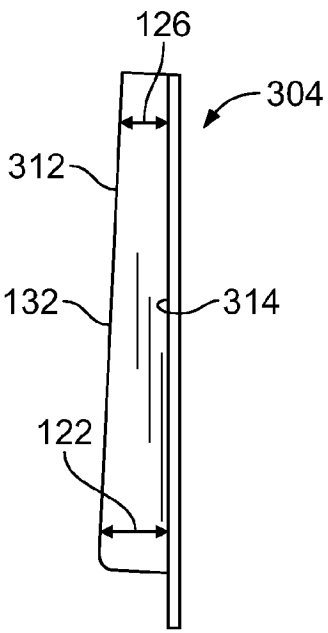
FIG. 3B is a side view of a top wall member of the liner system shown in FIG. 2.
Figure 3C:
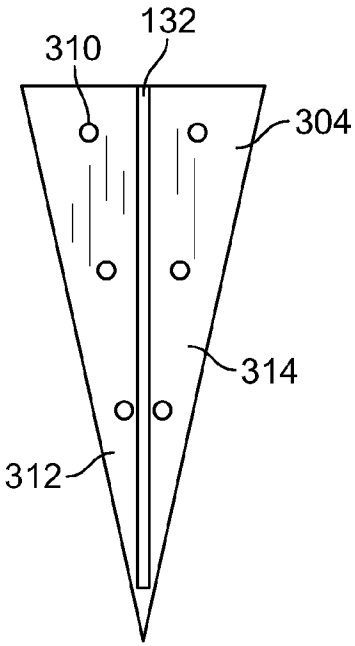
FIG. 3C is a plan view of the top wall member of the liner system shown in FIG. 2.
Figure 3D:
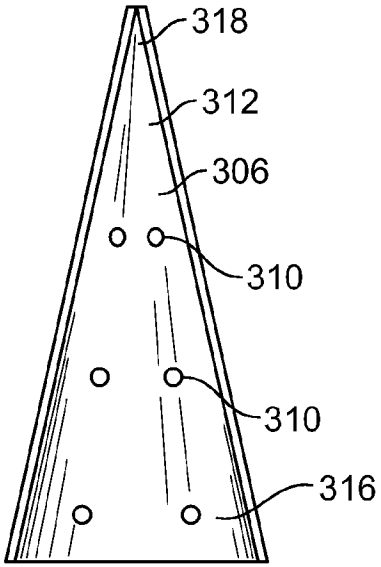
FIG. 3D is a plan view of a corner member of the liner system shown in FIG. 2.
Figure 3E:
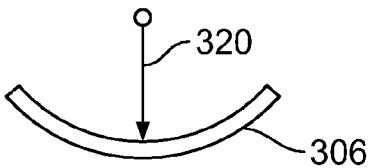
FIG. 3E is an elevation view of the corner member of the liner system shown in FIG. 2.
Figure 3F:
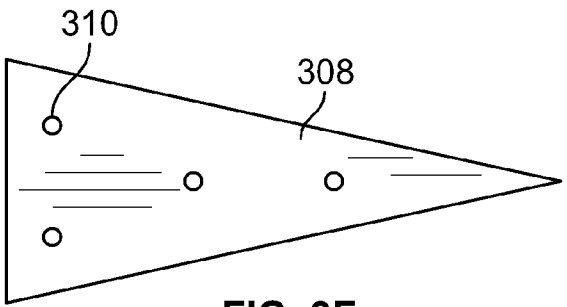
FIG. 3F is a plan view of a side wall member of the liner system shown in FIG. 2.

FIG. 3A is a plan view of a bottom wall member 302 of liner system 101 (shown in FIG. 1) in accordance with an exemplary embodiment of the present invention. FIG. 3B is a side view of a top wall member 304 of liner system 101. FIG. 3C is a plan view of top wall member 304 of liner system 101. FIG. 3D is a plan view of a corner member 306 of liner system 300 of liner system 101. FIG. 3E is an elevation view of corner member 306 of liner system 101. FIG. 3F is a plan view of a side wall member 308 of liner system 101.

In the exemplary embodiment, bottom wall member 302 and side wall members 308 include a polygonally-shaped substantially planar body. In one embodiment, top wall member 304, bottom wall member 302, side wall members 308, and corner members 306 includes one or more weld inserts 310 to facilitate coupling the members to burner nozzle shell 100. In various other embodiments, top wall member 304, bottom wall member 302, side wall members 308, and corner members 306 do not include weld inserts 310. Rather the members are adhered to burner nozzle shell 100 using an adhesive. In the exemplary embodiment, top wall member 304 includes a substantially planar body having an integrally formed anti-roping bar 312 that extends outwardly from a surface 314 of top wall member 304 to predetermined height 122, 126 into a flow path through the duct. In one embodiment, anti-roping bar 312 extends orthogonally away from surface 314. In other various embodiments, anti-roping bar 312 is canted in a circumferential direction about longitudinal axis 130. In one embodiment, anti-roping bar 312 extends away from surface 314 at a substantially constant height along an axial length of anti-roping bar 312. In various other embodiments, anti-roping bar 312 extends away from surface 314 such that a distance from radially inner surface 132 to burner nozzle shell 100 is substantially constant along an axial length of anti-roping bar 312.

Corner member 306 includes a curved polygonal shape, an inlet end 316, and an outlet end 318. Inlet ends 316 of a plurality of corner members 306 are configured to inscribe an inlet end opening 125 along the inner surface of burner nozzle shell 100. Corner member 306 further includes a curvature having a radius 320 that substantially matches a radius of a transition of burner nozzle shell 100 from inlet end 124 to outlet end 128.

In the exemplary embodiment, bottom wall member 302, top wall member 304, side wall member 308 and corner member 306 include one or more weld inserts 310 extending therethrough. In an alternative embodiment, bottom wall member 302, top wall member 304, side wall member 308, and corner member 306 do not include weld inserts 310. Also in the exemplary embodiment, bottom wall member 302, top wall member 304, side wall member 308, and corner member 306 comprise a ceramic material such as, but not limited to a nitride bonded silicon carbide material.

Figure 4:
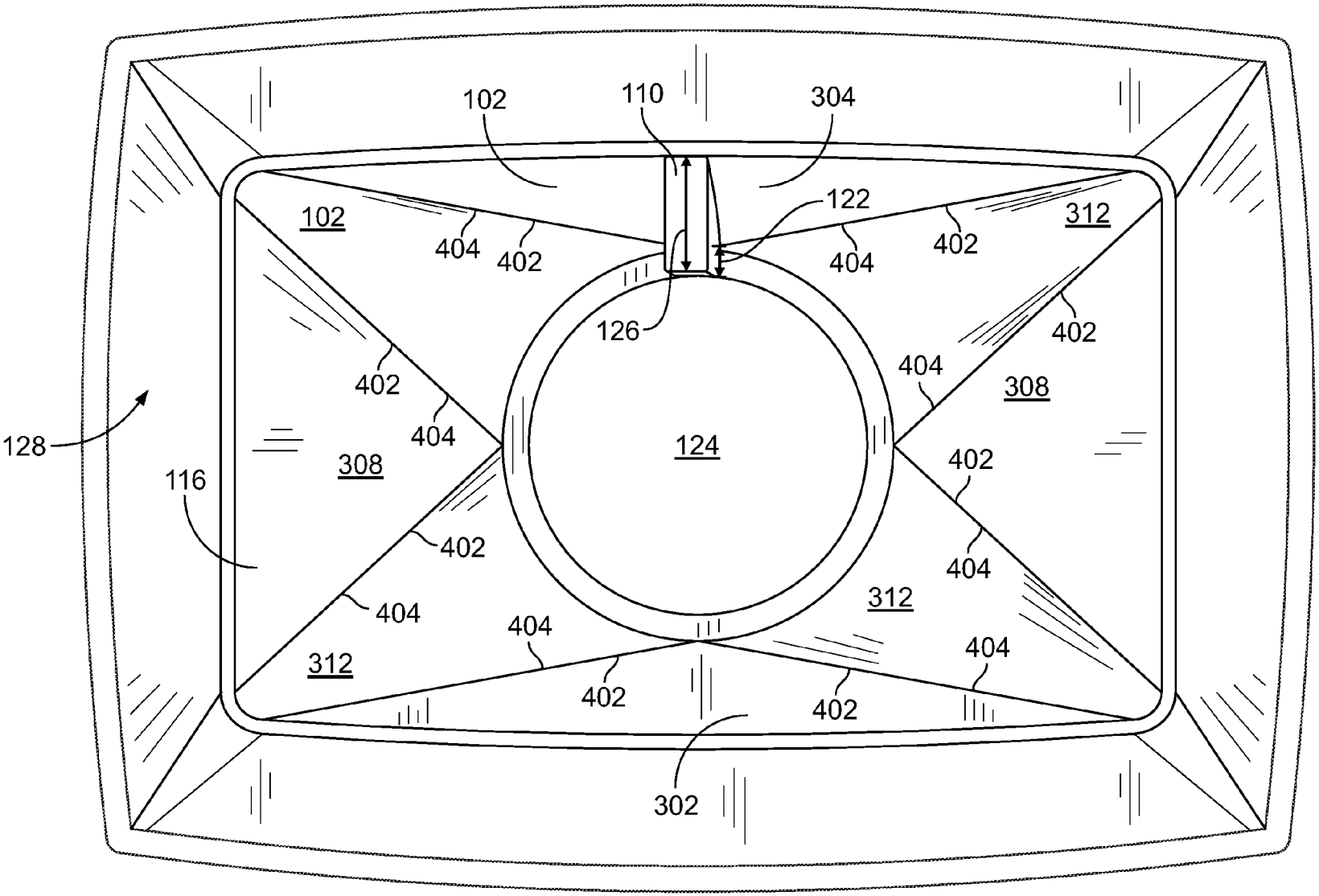

FIG. 4 is a perspective view of burner nozzle shell 100 looking from outlet end 128 through burner nozzle shell 100 to inlet end opening 125 at an angle with respect to axis 130. In the exemplary embodiment, edges 402 of bottom surface 112, top surface 114, and side surfaces 116 diverge with respect to an opposing edge of the same surface, 112, 114, 116 while edges 404 of corner members 306 converge with respect to an opposing edge of the same corner member 306.

Figure 5:
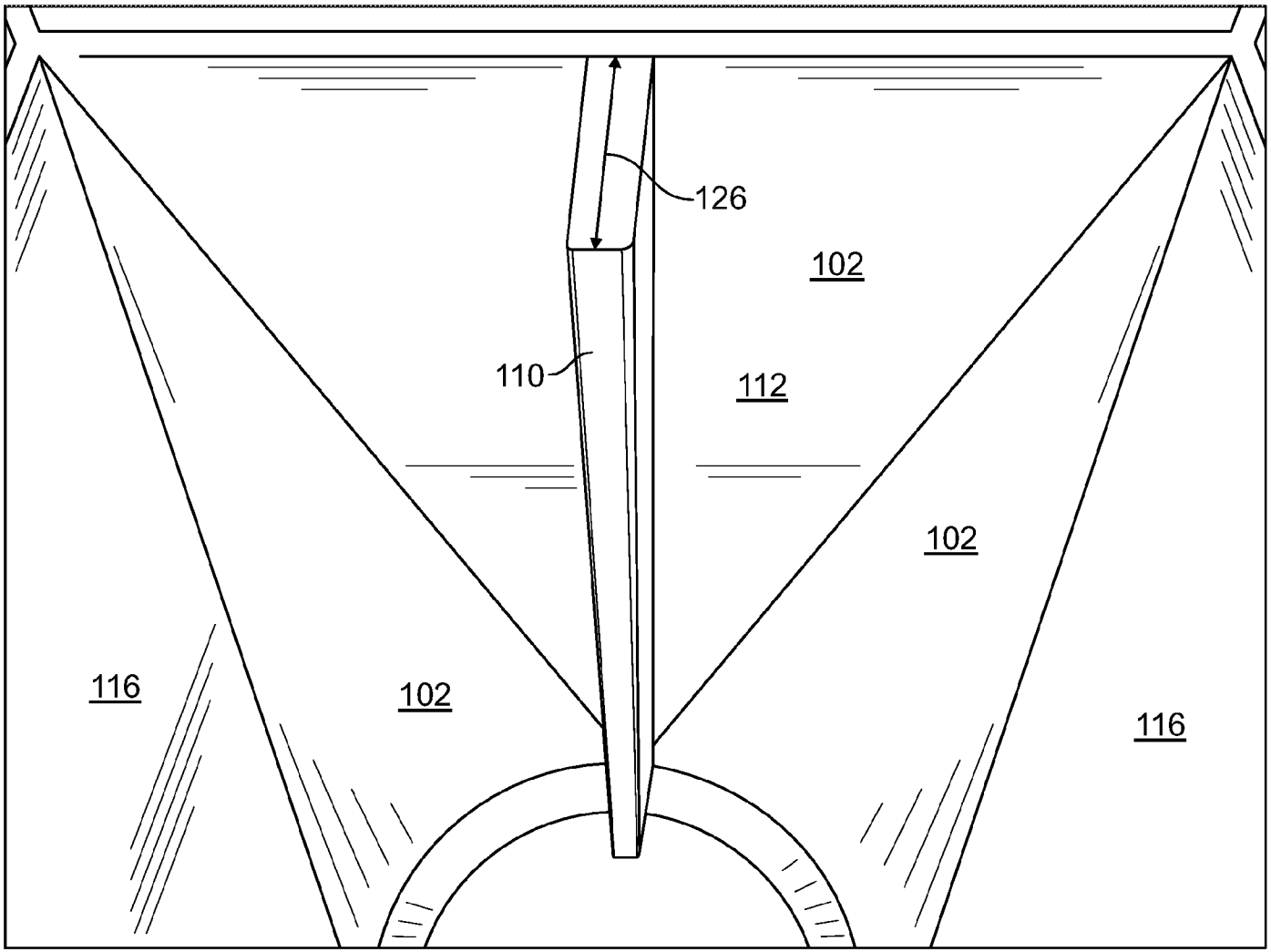

FIG. 5 is another perspective view of burner nozzle shell 100 looking from outlet end 128 through burner nozzle shell 100 to inlet end opening 125.

The above-described embodiments of a method and system for lining a burner nozzle used with a coal-fired furnace provides a cost-effective and reliable means for reducing wear and dispersing roping in a pulverized coal burner. The components illustrated are not limited to the specific embodiments described herein, but rather, components of each may be utilized independently and separately from other components described herein. Each system component can also be used in combination with other system components.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A liner system for a conduit for pneumatically conveying a particulate stream, the conduit comprising an inlet opening, an outlet opening, and a duct extending therebetween, said system comprising:

a plurality of polygonally-shaped wall members extending between an inlet opening end of the conduit and an opposing outlet opening end of the conduit, each wall member abutting another wall member to line an interior surface of the duct with the wall members;

wherein at least one of the wall members comprises an integrally formed anti-roping bar extending outwardly from a surface of the at least one wall member a predetermined height into a flow path through the duct, wherein the wall members are arranged such that the anti-roping bar extends from a first location within the duct proximate to the inlet opening end to a second location within the duct proximate to the outlet opening end.

2. A liner system in accordance with claim 1 wherein the at least one wall member comprising the integrally formed anti-roping bar comprises a first anti-roping wall member extending from the first location to the second location, wherein the anti-roping bar is a single, continuous bar extending from the first location to the second location.

3. A liner system in accordance with claim 1 wherein the at least one wall member comprising the integrally formed anti-roping bar comprises:

a first anti-roping wall member having an integrally formed first anti-roping bar section extending outwardly therefrom into the duct flow path; and a second anti-roping wall member having an integrally formed second anti-roping bar section extending outwardly therefrom into the duct flow path, wherein the anti-roping bar comprises the first and second anti-roping bar sections.

4. A liner system in accordance with claim 3 wherein the anti-roping bar extends orthogonally away from the first and second anti-roping wall members.

5. A liner system in accordance with claim 3 wherein said duct comprises a longitudinal axis extending through a center of said inlet opening and said outlet opening and wherein said anti-roping bar varies in height along an axial length of the anti-roping bar.

6. A liner system for a conduit for pneumatically conveying a particulate stream, the conduit comprising an inlet opening, an outlet opening, a duct extending therebetween, and a longitudinal axis extending through the longitudinal center of the duct, said system comprising:

a plurality of wall members lining an inside area of the duct between the inlet opening and the outlet opening end of the conduit, each of the wall members adjacent to another wall member of the plurality of wall members; and an anti-roping bar integrally formed with at least one of the plurality of wall members and extending toward the longitudinal axis of the duct, wherein the anti-roping bar extends in a substantially straight line from a first location within the duct proximate to the inlet opening to a second location within the duct proximate to the outlet opening.

7. A liner system for a conduit for pneumatically conveying a particulate stream, the conduit comprising an inlet opening, an outlet opening, and a duct extending therebetween, said system comprising:

a first polygonally-shaped wall member extending from an inlet opening end of the conduit to an opposing outlet opening end of the conduit, said first wall member comprising a substantially planar body;

a second polygonally-shaped wall member extending from the inlet opening end of the conduit to the opposing outlet opening end of the conduit, said second wall member comprising a substantially planar body having an integrally formed anti-roping bar that extends outwardly from a surface of the second wall member a predetermined height into a flow path through the duct; and a curved polygonally-shaped corner member extending from the inlet opening end of the conduit to the opposing outlet opening end of the conduit.

8. A liner system in accordance with claim 7 wherein said conduit comprises:

an inlet opening that is substantially elliptical in cross-section; and an outlet opening that is substantially rectangular in cross-section.

9. A liner system in accordance with claim 7 wherein said conduit comprises a transition from a substantially elliptical cross-section to a substantially rectangular cross-section.

10. A liner system in accordance with claim 7 further comprising a plurality of curved polygonally-shaped corner members coupled to an inner surface of said duct, each of plurality of curved polygonally-shaped corner members comprising an inlet end and an outlet end, the inlet ends of said plurality of curved polygonally-shaped corner members inscribing said inlet opening along the inner surface of the duct.

11. A liner system in accordance with claim 7 wherein the curved polygonally-shaped corner member comprises a curvature having a radius that substantially matches the radius of a transition from the inlet opening to the outlet opening.

12. A liner system in accordance with claim 7 wherein said members comprise at least one weld insert extending therethrough.

13. A liner system in accordance with claim 7 wherein said members comprise a ceramic material.

14. A liner system in accordance with claim 13 wherein said members comprise a nitride bonded silicon carbide material.

15. A liner system in accordance with claim 7 wherein said anti-roping bar extends orthogonally away from said second wall member.

16. A liner system in accordance with claim 7 wherein said duct comprises a longitudinal axis extending through a center of said inlet opening and said outlet opening and wherein said anti-roping bar is canted in a circumferential direction about said longitudinal axis.

17. A liner system in accordance with claim 7 wherein said duct comprises a longitudinal axis extending through a center of said inlet opening and said outlet opening and wherein said anti-roping bar varies in height along an axial length of the anti-roping bar.

18. A liner system for a conduit for pneumatically conveying a particulate stream, the conduit comprising an inlet opening, an outlet opening, and a duct extending therebetween, said system comprising:

a plurality of wall members;

a plurality of anti-roping wall members; and an anti-roping bar comprising a plurality of anti-roping bar sections, wherein the wall members and the anti-roping wall members extend between an inlet opening end of the conduit to an opposing outlet opening end of the conduit, each of the wall members abutting at least one of another wall member and one of the anti-roping wall members to line an interior surface of the duct, wherein each of the anti-roping wall members comprises an integrally formed anti-roping bar section extending outwardly from a surface of the associated anti-roping wall member a predetermined height into a flow path through the duct, wherein the anti-roping wall members are arranged such that the anti-roping bar extends in a substantially straight line from a first location within the duct proximate to the inlet opening end to a second location within the duct proximate to the outlet opening end.

19. A pulverized coal burner comprising:

a nozzle tip, at least partly protruding into a furnace; and a pulverized coal nozzle coupled in flow communication between said nozzle tip and a supply of a flow of fluidly conveyed particulate fuel, said pulverized coal nozzle comprising a duct having an inlet opening, an outlet opening, and a plurality of walls extending therebetween; and a liner system formed of abrasion resistant ceramic tiles coupled to said plurality of walls along an inner surface of the duct wall, said liner system includes:

a first polygonally-shaped wall member extending from the inlet opening to the outlet opening, said first wall member comprising a substantially planar body;

a second polygonally-shaped wall member extending from the inlet opening to the outlet opening, said second wall member comprising a substantially planar body having an integrally formed anti-roping bar that extends outwardly from a surface of the second wall member a predetermined height into a flow path through the duct; and a curved polygonally-shaped corner member extending from an inlet opening end of the conduit to an opposing outlet opening end of the conduit.

20. A burner in accordance with claim 19 wherein said conduit comprises:

an inlet opening that is substantially elliptical in cross-section and configured to couple to a complementarily-shaped coal conveying pipe; and an outlet opening that is substantially rectangular in cross-section.

21. A burner in accordance with claim 19 further comprising a plurality of curved polygonally-shaped corner members coupled to an inner surface of said duct, each of plurality of curved polygonally-shaped corner members comprising an inlet end and an outlet end, the inlet ends of said plurality of curved polygonally-shaped corner members inscribing said inlet opening along the inner surface of the duct.

22. A burner in accordance with claim 19 wherein said members comprise a nitride bonded silicon carbide material.

23. A burner in accordance with claim 19 wherein said anti-roping bar extends orthogonally away from said second wall member.

24. A burner in accordance with claim 19 wherein said duct comprises a longitudinal axis extending through a center of said inlet opening and said outlet opening and wherein said anti-roping bar is canted in a circumferential direction about said longitudinal axis.

* * * * *